US005535482A

United States Patent [19]

Grabber

[11] Patent Number: 5,535,482

[45] Date of Patent: Jul. 16, 1996

[54] WIDE ANGLE HINGE WITH AN OPENING ANGLE OF ABOUT 180 DEGREES

[75] Inventor: Günther Grabber, Fussach, Austria

[73] Assignee: Grass AG, Hochst/Vlbg., Austria

[21] Appl. No.: 253,850

[22] Filed: Jun. 3, 1994

[30] Foreign Application Priority Data

Jun. 4, 1993 [DE] Germany ..... 43 18 607.6

[51] Int. Cl.[6] ..... E05D 11/06; E05F 1/12

[52] U.S. Cl. ..... 16/286; 16/358; 16/362; 16/363; 16/364

[58] Field of Search ..... 16/357, 358, 360, 16/362, 364, 277, 286, 304

[56] References Cited

U.S. PATENT DOCUMENTS

| | | | |
|---|---|---|---|
| 4,091,501 | 5/1978 | Lautenschlager et al. | 16/357 |
| 4,584,738 | 4/1986 | Lautenschlager | 16/364 |
| 4,979,265 | 12/1990 | Grass | 16/291 |

FOREIGN PATENT DOCUMENTS

| | | | |
|---|---|---|---|
| 1559893 | 3/1970 | Germany | 16/364 |
| 2511201 | 9/1976 | Germany | 16/357 |
| 2823090 | 11/1979 | Germany | 16/357 |
| 2049800 | 12/1980 | United Kingdom | 16/333 |
| 2070129 | 9/1981 | United Kingdom | 16/357 |
| WO9015911 | 12/1990 | WIPO | 16/357 |

*Primary Examiner*—M. Rachuba
*Assistant Examiner*—Donald M. Gurley
*Attorney, Agent, or Firm*—Petree Stockton

[57] ABSTRACT

A wide angle hinge includes an assembly casing fastenable on a cabinet carcass and having front and back slots which engage corresponding front and back pins connected to a hinge arm, so that the hinge arm is slidable and rotatable relative to the assembly casing. The hinge arm is also connected by an articulation arm to a hinge cup fastenable in a door. A pull mechanism is fastened on one end in the assembly casing and on the other end in the hinge cup, and a deflection roller disposed in the assembly casing and the articulation arm cooperatively guide and continuously hold the pull mechanism under tension.

16 Claims, 3 Drawing Sheets

WIDE ANGLE HINGE WITH AN OPENING ANGLE OF ABOUT 180 DEGREES

BACKGROUND AND FIELD OF THE INVENTION

The invention concerns a wide angle hinge. A wide angle hinge of this type was made known, for example, with the Austrian Patent Application 182/80.

In general the problem with wide angle hinges is that when the door swings open from a closed position to an open position, a lifting movement of the door will occur by the front edge of the cabinet carcass in order to swing away a certain distance from the front edge of the cabinet carcass.

Hereby, the door which swings away, should be prevented from colliding with a side wall or a neighboring door.

It is the purpose of the submitted Austrian Patent Application 182/80 that an assembly casing is fastened on the cabinet carcass, which has two slots which lie behind one another. Pins engage back through these slots. These pins are connected with a hinge arm which can be slid and, to some extent, can be pivoted in this assembly casing.

The hinge arm is also guided sliding and, to some extent, pivoting by the pins which are engaged in the slots of the assembly casing.

The previous Patent application uses a rack pinion slide; whereby, a first rack is placed on the articulation lever of the hinge. This articulation lever is guided slidable in the hinge arm. When the door is opened, this articulation lever slides in relation to the hinge arm and the rack which is fastened thereon engages a pinion, which is located secure, yet slidable, rotatable on the pins which engage back through a slot in the assembly casing.

This pinion meshes with a second rack, which is fixed in close proximity to a slot on the assembly casing.

A pivot gear of the pinion over the sliding rack thus results from the swinging of the door and the sliding of an articulation arm., and this pinion then slides along the stationary second rack which results in a relative movement of the hinge arm to the fixed assembly casing.

The disadvantage of this previous gear system is that the previous hinge has a relatively high overall height because of the placement of two racks which lie under one another and a pinion which lies in between. The manufacturing costs are extraordinarily large because of the relatively costly gear system, and the operational dependability and security can not always be guaranteed over the long term.

SUMMARY OF THE INVENTION

The purpose of the invention is to further develop and improve a device for the previously mentioned wide angle system so that less costly manufacturing costs and longer durability can be achieved with a fundamentally simpler system.

A fundamental feature of the feature is that a closed pull mechanism on the one side is turned around the hinge cup and on the other side, turned around over a deflection position (farthest from the door) in the hinge arm, and fastened with its other end on the assembly casing. It concerns then a pull mechanism, which is fastened on the one side on the hinge cup and on the other side is fastened on the assembly casing and which is turned around over a deflection roller which is located pivotable; on a pin which engages back through one of the slots and which is steadily taut.

Hereby, it is included in the submitted invention that the pull mechanism in the first embodiment is guided over the back pin (farthest from the door) while in a second embodiment of the pull mechanism, the engaged pin is guided over the front in the front slot.

The pull mechanism system has the fundamental advantage that the costly rack gear with two racks can be eliminated and that instead a simple, durable pull mechanism shall be utilized, which consists of, for example, a steel band, a chain, a wire cable, a plastic band, a plastic strap or something similar.

When the door swings out, the articulated position of the pull mechanism on the hinge cup is subjected to tensile stress and this pull is transferred over the non expandable pull mechanism on the slidable pins, so that this pull shall be slid positively constrained in its slot slide while the opposite end of the pull mechanism is fastened fixed and non-slidable on the assembly casing.

This results in, first, a lifting motion of the hinge cup from the cabinet edge (front edge of the cabinet carcass ), while the hinge arm is slid in the slots and the slots are placed so that the hinge arm is set up angled horizontally upward in order to achieve the required lifting movement.

Therefore, it is essential that the pull mechanism is deflected over the articulation arm with the widening opening movement of the door. The surface of the articulation arm is formed as a radial cam. According to the shaping of this radial cam, the speed of the door's lifting movement can be controlled. When this radial cam is very curved, then the pull mechanism is correspondingly unwound over this bent radial cam surface and correspondingly shortened so that a quick and larger sliding movement follows.

On the contrary, when the radial cam is more flatly shaped, then the pull mechanism is correspondingly also only slightly deflected on this radial cam; whereby, a slight sliding of the hinge arm in the assembly casing and a correspondingly slower sliding motion of the hinge arm in the assembly casing follows.

The speed of the sliding movement can just as well be determined by changing the articulation point of the pull mechanism in the hinge cup and in the assembly casing. Hereby, it is provided that this articulation point is designed to be adjustable.

In another embodiment it is provided that the deflection of the pull mechanism does not follow over a deflection roller, which is placed pivotable on one of the pins in the hinge arm, but instead, that the deflection roller slips away and the pull mechanism is directly deflected over one of the pins.

The pull-back motion of the hinge from an open position to a closed position results from a pressure spring. One end of this spring is located on a fixed point on the assembly casing and the other end is hinged on one of the slidable pins. When the hinge is in the open position, this pressure spring presses with force on the pins so these pins move again in their slots in the direction of the closed position of the hinge.

Therefore, it is not relevant for the general function of the wide angle hinge if the pull mechanism is taut when opening the door. Notwithstanding, it produces a closing pressure, which holds the closed door in the closed position.

In a similar manner, the opened door can be held open when the pull mechanism can be pulled so far outwardly over a radial cam that no pressure components can take place in the moving direction of the pins. Either a special radial cam or a special guiding, and slot cam is required for this.

Furthermore, the door can be adjusted so that the pivot point of the articulation arm in the hinge cup can be pulled over the radial cam.

Instead of the pressure spring described here, other pull-back elements may be utilized, as, for example, hydraulic or pneumatic pull-back elements, rubber elastic elements and other similar elements.

Even so, it is provided in a further development of the submitted invention, the pull mechanism is not hinged on two opposite lying ends in varying positions, but instead the pull mechanism of the closed drum activates the sliding of the hinge arm outwardly over the cabinet front side in a direction of the open position, during which the pull mechanism in the closed position independently pushes back the hinge arm without requiring additional pull back elements such as pressure springs or other elements. Even so, it is provided in a further development of the invention, that an equalizing offsetting element is placed in the pull mechanism itself, in order to offset an unacceptable and excessive extension in the pull mechanism.

When one places a rubber elastic element in the pull mechanism, that is, when the pull mechanism consists of a rubber elastic material, then it is likewise possible to attain the features of an automatic closing or opening; that is, the pull mechanism presses then a closing force on the door in a closed position and it is also possible to design and form the pull mechanism in such a way that it also presses a certain opening force on the door in an open position.

Instead of fitting equalizing offsetting elements :of the same types, additional elements can also be provided in the assembly casing, as for example, additional pressure springs which produce these closing and opening pressure forces.

The inventive basis of the submitted invention results from not only the matter of the individual patent claims, but also the various combinations of the individual patent claims. All records, documents and evidence, inclusive of the summary, open and disclosed statements and declarations, especially those represented embodiments in the drawings, will be claimed as fundamental and significant inventions, as far as the claims individually or in combinations are relative to the position that the technology is new.

The invention at hand will be explained more precisely by the various embodiments shown by representational drawings. Hereby, additional significant and fundamental features and advantages of the invention will be concluded from the designs and their descriptions.

Figure 1:
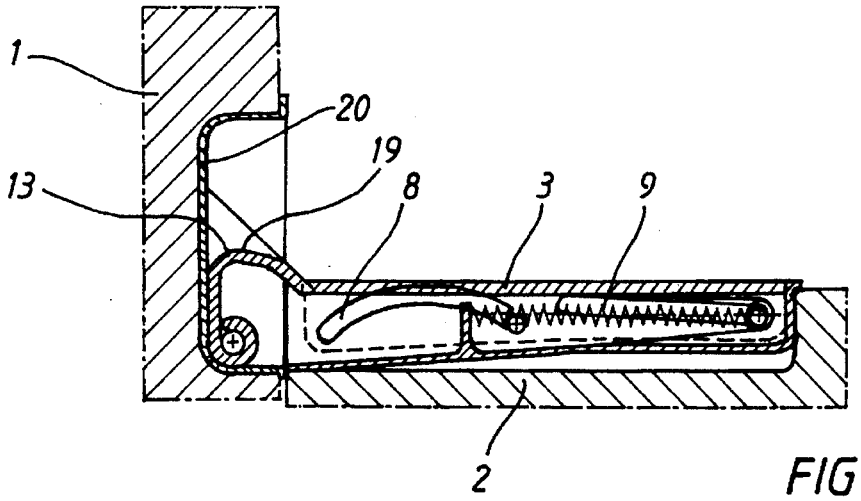
FIG. 1: a schematic section through the hinge in the closed position according to the invention.

Please note that in the following drawings, a so called single articulation hinge is shown, but the invention is not limited to just this. The invention encompasses all single articulation and two articulation hinges because the essence of the invention is simply the specific gear system which is an improvement over the present status of the technology.

DESCRIPTION OF THE PREFERRED EMBODIMENTS

The hinge consists fundamentally of a recessed hinge cup (4) in a door (1) which is connected over a corresponding pivot pin and an articulation arm (13) with the hinge arm (3). The articulation arm (13) is a component of the hinge arm (3).

The hinge arm (3) is located slidable in an assembly casing (5) which is fastened in cabinet carcass (2). The assembly casing (5) has two slots (8,9) which lie behind one another; whereby, the front slot (8) closest to the door is curved shaped (bent) while the back slot farthest from the door is angled upward and formed straight.

The respective slots (8,9) engage the pins (6,7) which are connected with the hinge arm (3).

The pins (6, 7) can be either through pins, in as much as a U-shaped profiled hinge arm (3) can be utilized, or it can simply be a wart shaped extension which is placed laterally inwardly directed and engages in the corresponding slots (8,9) and there is guided slidable.

A pull mechanism (10) is fastened by position 11 on the bottom of the hinge cup (4); whereby, this pull mechanism (10) is guided over the bent arc formed radial cam (19) of the articulation arm (13) and is guided in the hinge arm (3) over a deflection roller (15), which is located rotatable on the pin (7). The other end of the pull mechanism (10) is fastened on the bottom of the assembly casing (5) by position (12).

Figure 4:
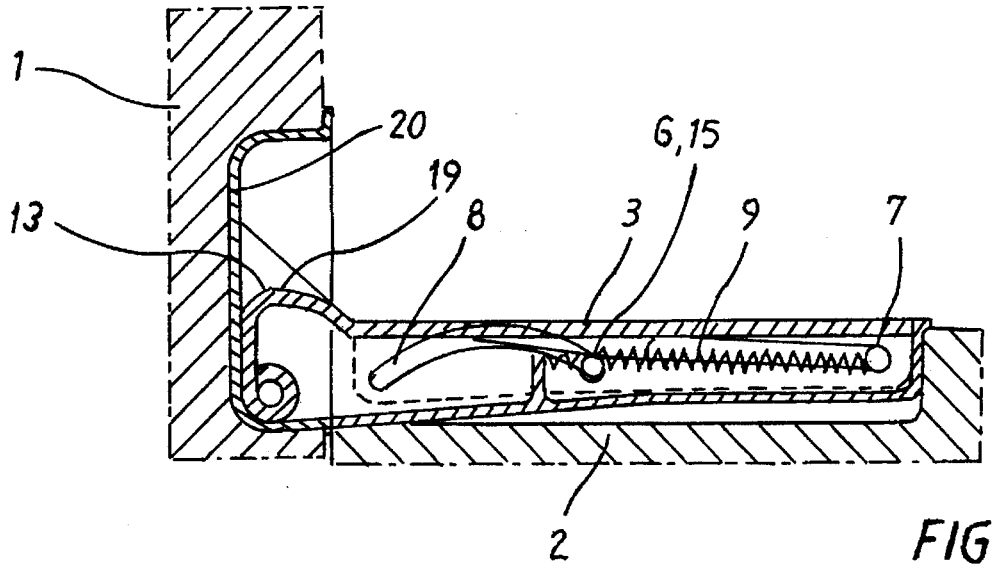
FIG. 4: an alternate embodiment of the hinge.
Figure 6:
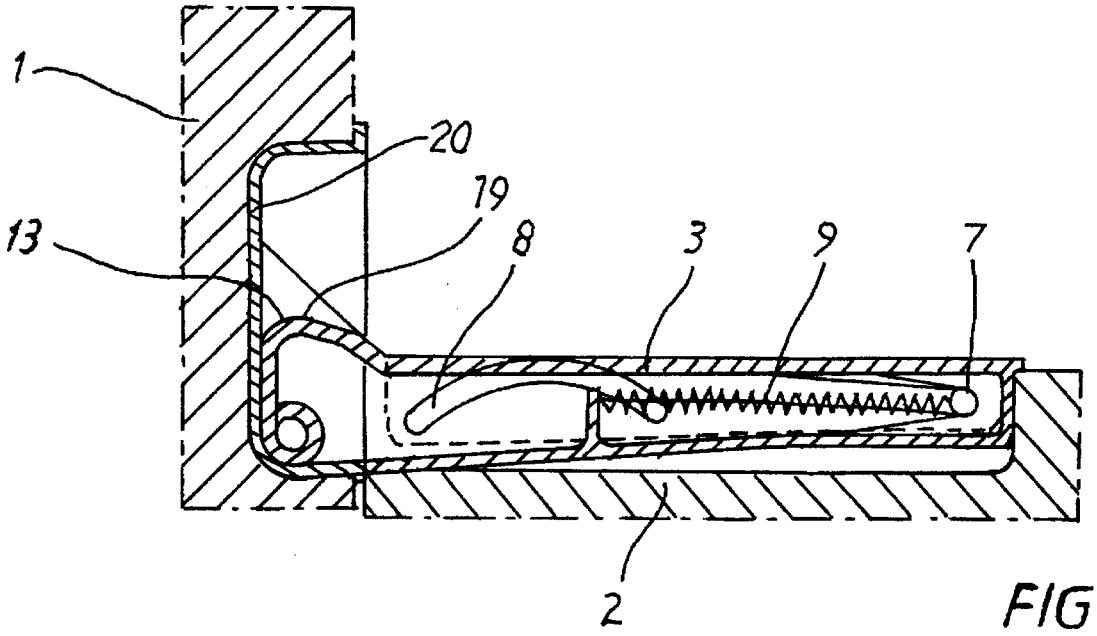
FIG. 6: a third alternate embodiment of the hinge.

Alternately, deflection roller (15) can be engaged on pin (6) and pull mechanism (10) turned around roller (15) as shown in FIG. 4, or pull mechanism (10) can be directly turned around pin (7) without a deflection roller as shown in FIG. 6.

Figure 3:
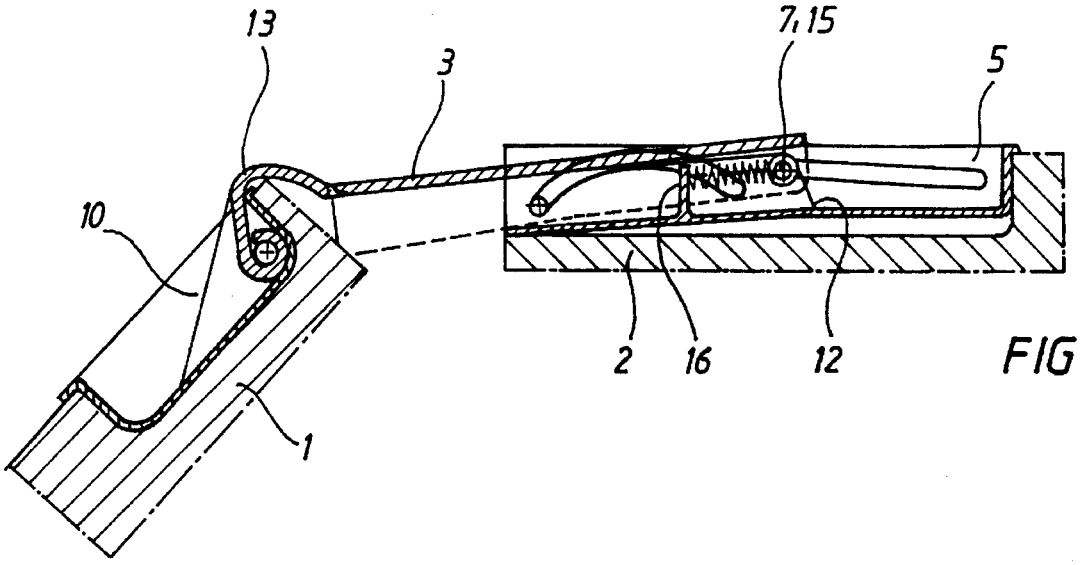
FIG. 3: the hinge in the opened position.

One end of a pressure spring (14) is fastened On a stay (16) of the assembly casing (5) which is supported with its other end in the area of the pin (7) and puts pressure on this when the hinge, according to FIG. 3, is in the opened position.

Figure 5:
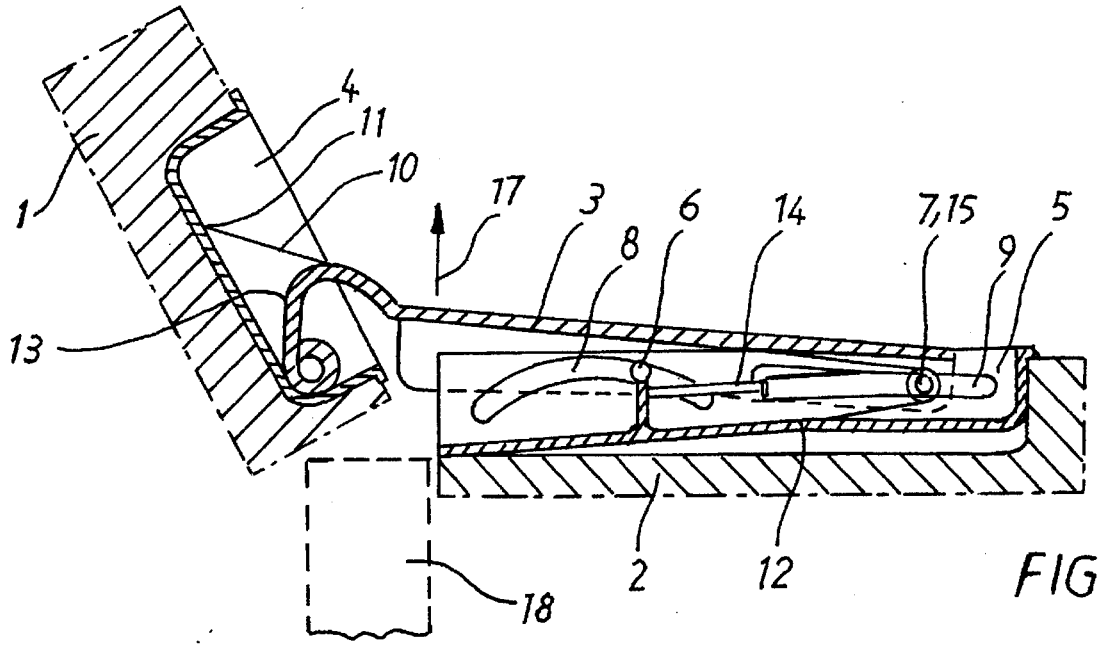
FIG. 5: a second alternate embodiments of the hinge.

Alternately, as shown in FIG. 5, a hydraulic or pneumatic element (14) may be used in place of a pressure spring for the same purpose.

Figure 2:
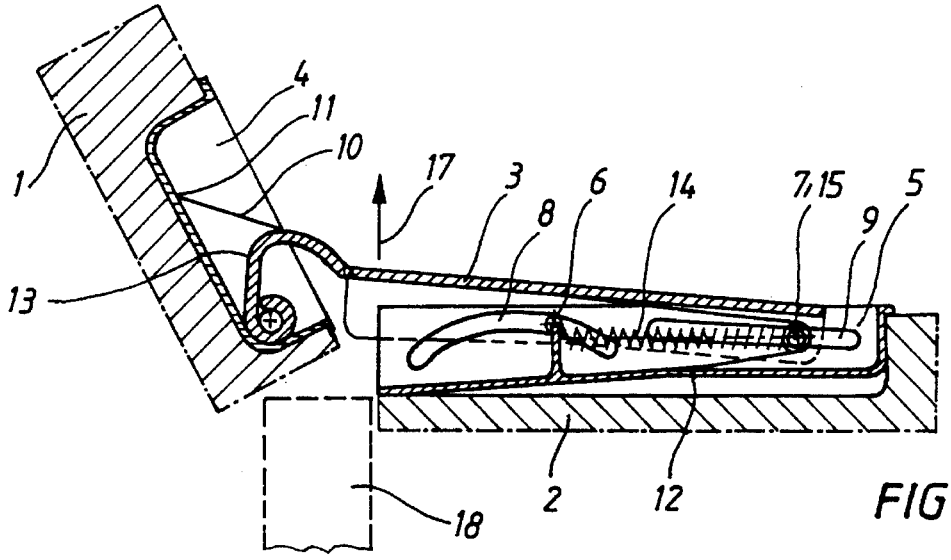
FIG. 2: the hinge in the intermediate area between the opened and closed position.

The crossover from the closed position (FIG. 1) to the opened position (FIG. 2, FIG. 3) results next in an elongation of the pull mechanism (10) because the door (1) will swing outwardly and hereby, a pulling force will press on the pull mechanism (10). It will be unrolled correspondingly more or less over the radial cam (19); whereby, the hinge arm (3) lifts upwardly in the arrow direction (17), in order to achieve a lifting movement in relation to a fixed side wall (18) (FIG. 2). Hereby, this results simultaneously in a shifting of the pins (6,7) in the slots (8,9).

When the opened position is achieved, the pins (6,7) run up to the boundaries of the slots (8,9); whereby, it is preferred that the slots are so directed that the hinge arm (3) is somewhat downwardly slanted in order to guarantee an even better accessibility to the inner space of the cabinet carcass (2).

I claim:

1. Wide angle hinge for a piece of furniture having a cabinet carcass and a door which is moveable between closed and open and extended open positions, comprising:

an assembly casing having a front end and a back end and fastenable on said cabinet carcass with the front end disposed toward said door and the back end disposed away from said door, the assembly casing having portions defining a front slot proximate the assembly casing front end and a back slot spaced from the front slot toward the assembly casing back end;

a deflection roller disposed in the assembly casing;

pressure means biasing said deflection roller toward the back end of said assembly casing;

a hinge cup fastenable in said door;

a hinge arm having portions defining an articulation arm and connected to the hinge cup by the articulation arm;

a front pin engaged in the assembly casing front slot and a back pin engaged in the assembly casing back slot one of said pins mounting said deflection roller, the hinge arm being connected to each of said pins, whereby the hinge arm is slidable and rotatable relative to the assembly casing; and a pull mechanism having two ends, one of said ends being fastened in the assembly casing and the other of said ends being fastened in the hinge cup, said pull mechanism, intermediate said ends, being directed about said deflection roller and over said articulation arm, said deflection roller and articulation arm cooperatively guiding and continuously holding the pull mechanism under tension.

2. Wide angle hinge, according to claim 1, wherein said deflection roller is located on said back pin in said assembly casing.

3. Wide angle hinge, according to claim 1, wherein said deflection roller is located on said front pin in said assembly casing.

4. Wide angle hinge, according to claim 1, wherein said pull mechanism is turned around directly on one of said front and back pins.

5. Wide angle hinge, according to any of claims 1, 2, 3, or 4, wherein said pull mechanism is held continuously under tension by said pressure means disposed between said deflection roller and a stay provided in said assembly casing.

6. Wide angle hinge, according to claim 5, wherein said pressure means comprises a compression spring.

7. Wide angle hinge, according to claim 1, wherein said pull mechanism consists of tensile strength material such as metal, especially steel, tensile strength plastic material or tensile strength textile fabric.

8. Wide angle hinge, according to claim 1, wherein said pull mechanism is embodied by a pull tension chain or a wire cable.

9. Wide angle hinge, according to claim 1, wherein said pull mechanism consists of rubber elastic material.

10. Wide angle hinge, according to claim 1, wherein said articulation arm includes portions defining a radial cam bent towards said pull mechanism.

11. Wide angle hinge, according to claim 10, wherein said radial cam of the articulation arm includes a flat surface.

12. Wide angle hinge, according to claim 1, wherein said assembly casing back slot has a front margin disposed toward said assembly casing front end and a rear margin disposed away from said assembly casing front end, and said deflection roller for the pull mechanism is placed on said back pin and is pressed against a spring of the pressure means by the pull mechanism, so that when said door is in said closed position, the back pin is held at the rear margin of said back slot and when said door is in said open position, the back pin at the front margin of said back slot.

13. Wide angle hinge, according to claim 1, wherein said assembly casing front slot has a front margin disposed toward said assembly casing front end and a rear margin disposed away from said assembly casing front end, and said deflection roller for the pull mechanism is placed on said front pin and is pressed against a spring of said pressure means by the pull mechanism so that when said door is in said closed position, the front pin is held at the rear margin of said front slot and when the door is in said open position, the front pin is held at the front margin of said front slot.

14. Wide angle hinge, according to claim 12 or 13 wherein said articulation arm includes portions defining a radial cam, and said front and back pins are held at said rear margins of the front and back slots, respectively, by said tension of the pull mechanism and said front and back pins are held at said rear margins of the front and back slots, respectively, by said radial cam.

15. Wide angle hinge according to claim 5, wherein said pressure means comprises an hydraulic element.

16. Wide angle hinge according to claim 5, wherein said pressure means comprises a pneumatic element.

* * * * *